US009869101B1

(12) United States Patent
Kitching

(10) Patent No.: US 9,869,101 B1
(45) Date of Patent: Jan. 16, 2018

(54) METHOD AND DEVICE FOR REMOVING A NON GROUND-BASED SCAFFOLDING SYSTEM BY A SINGLE USER

(71) Applicant: Del Kitching, El Cerrito, CA (US)

(72) Inventor: Del Kitching, El Cerrito, CA (US)

( * ) Notice: Subject to any disclaimer, the term of this patent is extended or adjusted under 35 U.S.C. 154(b) by 75 days.

(21) Appl. No.: 14/639,100

(22) Filed: Mar. 4, 2015

Related U.S. Application Data

(60) Provisional application No. 61/948,072, filed on Mar. 5, 2014.

(51) Int. Cl.
*E04G 3/20* (2006.01)
*E04G 5/04* (2006.01)
*E04G 5/00* (2006.01)

(52) U.S. Cl.
CPC ..... *E04G 5/046* (2013.01); *E04G 3/20* (2013.01); *E04G 5/007* (2013.01)

(58) Field of Classification Search
CPC ..... E04G 3/20; E04G 11/28; E04G 5/046; E04G 5/06; E04G 5/007; E04G 5/04; E04G 5/062; E04G 11/06; E04G 11/062; E04G 11/08; E04G 17/06; A47L 3/02
See application file for complete search history.

(56) References Cited

U.S. PATENT DOCUMENTS 1,423,998 A * 7/1922 Camp ..... E04G 3/34 182/150
1,724,851 A * 8/1929 Romyak ..... E04G 5/06 248/240.3
1,755,116 A * 4/1930 Henderson ..... E04G 5/06 248/240.3
1,928,124 A * 9/1933 Farley ..... A47L 3/02 182/61
2,736,615 A * 2/1956 Gormley ..... A47L 3/02 182/55
2,849,257 A * 8/1958 Woyton ..... A47L 3/02 182/55
3,998,294 A * 12/1976 Moeller ..... E04G 5/04 182/229
4,029,173 A * 6/1977 Wakabayashi ..... E04G 1/34 182/150
4,079,813 A * 3/1978 Ellison ..... A47L 3/02 182/62
5,203,426 A * 4/1993 Sydnor ..... A47L 3/00 182/55

(Continued)

*Primary Examiner* — Daniel Cahn
(74) *Attorney, Agent, or Firm* — Moss & Barnett; Michael A. Bondi

(57) ABSTRACT

An improvement to U.S. Pat. No. 6,003,630 comprising a method and device whereby the extension arm portion is removably attached and to the nail plate portion while attached to the exterior scaffolding portion, thus permitting a single user to take down the scaffolding easily and safely on their own without assistance. Additionally, the scaffold can now be safely lowered to the ground entirely from the building interior via a support line attached to the extension arm while it is attached to the exterior scaffolding. This improvement makes the 630 patent more efficient and much safer to use. Additionally, a spanner bracket for use with cement block or pour in place concrete walls is disclosed herein enabling a non ground-based scaffolding system in use with the 630 patent for such walls types, also permitting single user set up and removal of the scaffolding.

8 Claims, 8 Drawing Sheets

(56) References Cited

U.S. PATENT DOCUMENTS 5,341,898 A * 8/1994 Baziuk ..... E04G 3/34 182/142
5,823,289 A * 10/1998 Csomos ..... E04G 3/18 182/53
5,845,740 A * 12/1998 Bouwkamp ..... A62B 1/04 182/45
5,878,835 A * 3/1999 Gall ..... E04G 3/20 182/55
6,003,630 A * 12/1999 Whalen ..... E04G 3/20 182/150
6,003,631 A * 12/1999 Knauth ..... E04G 3/28 182/150
7,578,370 B1 * 8/2009 Morton ..... E04G 5/04 182/82
8,579,553 B2 * 11/2013 Pierce ..... B23B 51/00 254/134.3 R
9,145,694 B2 * 9/2015 Bulley ..... E04G 3/20
2002/0139614 A1 * 10/2002 Volkman ..... E04G 3/26 182/82
2004/0013483 A1 * 1/2004 Thomsen ..... B23B 51/08 408/226
2006/0175130 A1 * 8/2006 Riley ..... E04G 3/20 182/82
2008/0179477 A1 * 7/2008 Harney ..... E04G 5/046 248/238
2009/0014620 A1 * 1/2009 Cooper ..... E04G 3/20 248/610
2009/0223743 A1 * 9/2009 Jejina ..... E04G 1/38 182/150
2010/0025151 A1 * 2/2010 Guinart Pallares ..... E04G 5/04 182/112
2010/0281816 A1 * 11/2010 Vigneault ..... E04G 5/04 52/701
2012/0312940 A1 * 12/2012 Julliard ..... E04G 3/22 248/200.1
2013/0074308 A1 * 3/2013 Samons ..... E04G 1/38 29/428
2014/0209410 A1 * 7/2014 Villar Cloquell ..... E06C 7/48 182/107
2015/0191922 A1 * 7/2015 Giat ..... E04B 1/161 264/31

* cited by examiner

METHOD AND DEVICE FOR REMOVING A NON GROUND-BASED SCAFFOLDING SYSTEM BY A SINGLE USER

CROSS REFERENCE TO RELATED APPLICATIONS

The present invention includes a new and unobvious improvement to U.S. Pat. No. 6,003,630 issued on Dec. 21, 1999 which was filed as a continuation-in-part of application Ser. No. 08/881,769 on Jun. 24, 1997 which was abandoned. The present invention depends from Provisional Patent Application 61/948,072.

STATEMENT REGARDING FEDERALLY SPONSORED RESEARCH OR DEVELOPMENT

Not Applicable.

BACKGROUND OF THE INVENTION

The present invention relates to the scaffold system as described in U.S. Pat. No. 6,003,630 (see above). The present invention includes an improvement to U.S. Pat. No. 6,003,630. U.S. Pat. No. 6,003,630 describes a scaffolding system whereby a scaffold support structure is affixed to a wall employing a pinch-pull method whereby said scaffold structure, typically oriented against the external surface of a building wall, is held in place via a horizontal extension bracket that travels through a small aperture made in the building wall such that on the interior surface of the building wall said extension arm is part of a T-shaped attaching bracket. The extension arm is welded perpendicularly to a nail plate which is nailed to building wall stud elements through apertures in said nail plate. The attaching bracket therefore comprises the nail plate, the extension arm, apertures in the nail plate, and apertures in the portion of the extension arm that is used on the exterior side of the building wall for the purpose of affixing the scaffold portion to a wall constructed of 2*4, 2*6, or 2*8 boards with shear or without shear.

SUMMARY OF THE INVENTION

The present invention comprises an improvement to the 630 patent described above whereby changes to the attaching bracket make removal of the scaffold possible from just the interior of the building wall as opposed to the previous which required a person on the interior and the exterior of the building wall in order to extract the scaffolding. The present improvement further comprises a spanner bracket which permits attachment to and removal from either the external or internal side of a building wall being constructed of cement blocks or pour in place concrete. It is therefore a purpose of the present improvement to enable a single user to remove the scaffolding portion of the 630 patent from either the interior or exterior side of a wall or building being constructed. It is therefore another purpose of the present improvement to make installation and removal of the scaffolding portion of the 630 patent generally easier for any use, and in doing so making a safer work platform for the builder.

The characteristics and utilities of the present invention described in this summary and the detailed description below are not all inclusive. Many additional features and advantages will be apparent to one of ordinary skill in the art given the following description. There has thus been outlined, rather broadly, the more important features of the invention in order that the detailed description thereof that follows may be better understood, and in order that the present contribution to the art may be better appreciated.

In this respect, by explaining at least one embodiment of the invention in detail, it is to be understood that the invention is not limited in its application to the details of construction and to the arrangements of the components set forth in the description. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the description be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, nor is it intended to be limiting as to the scope of the invention in any way.

DETAILED DESCRIPTION

Figure 1A:
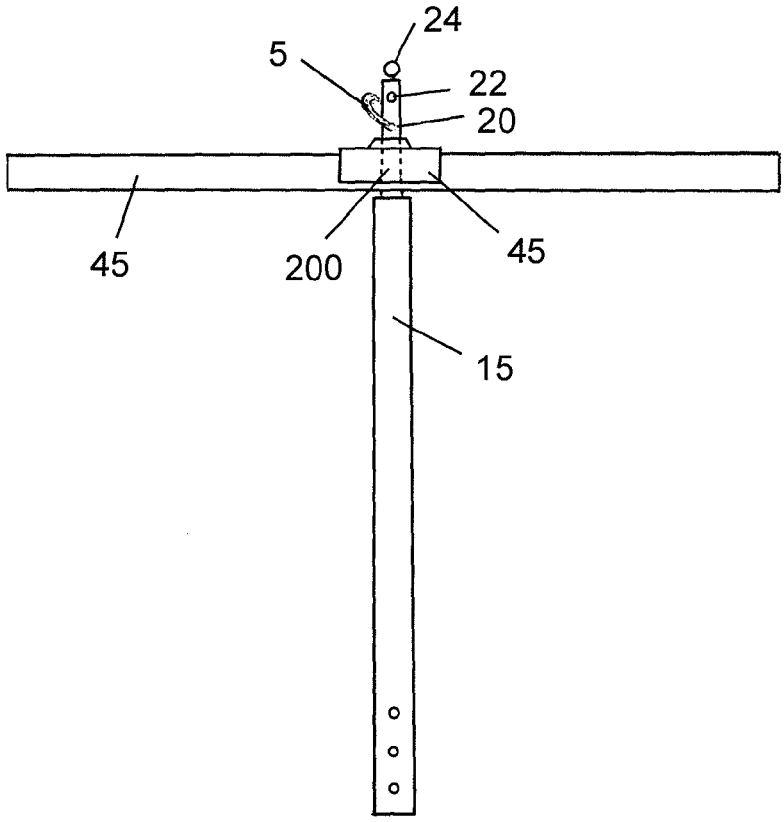
FIG. 1 is a top view of the attaching bracket with the extension arm interior end affixed to the nail plate via a pin, the eyelet and the open extension post aperture available for insertion of a rope or cable through it.
Figure 1B:
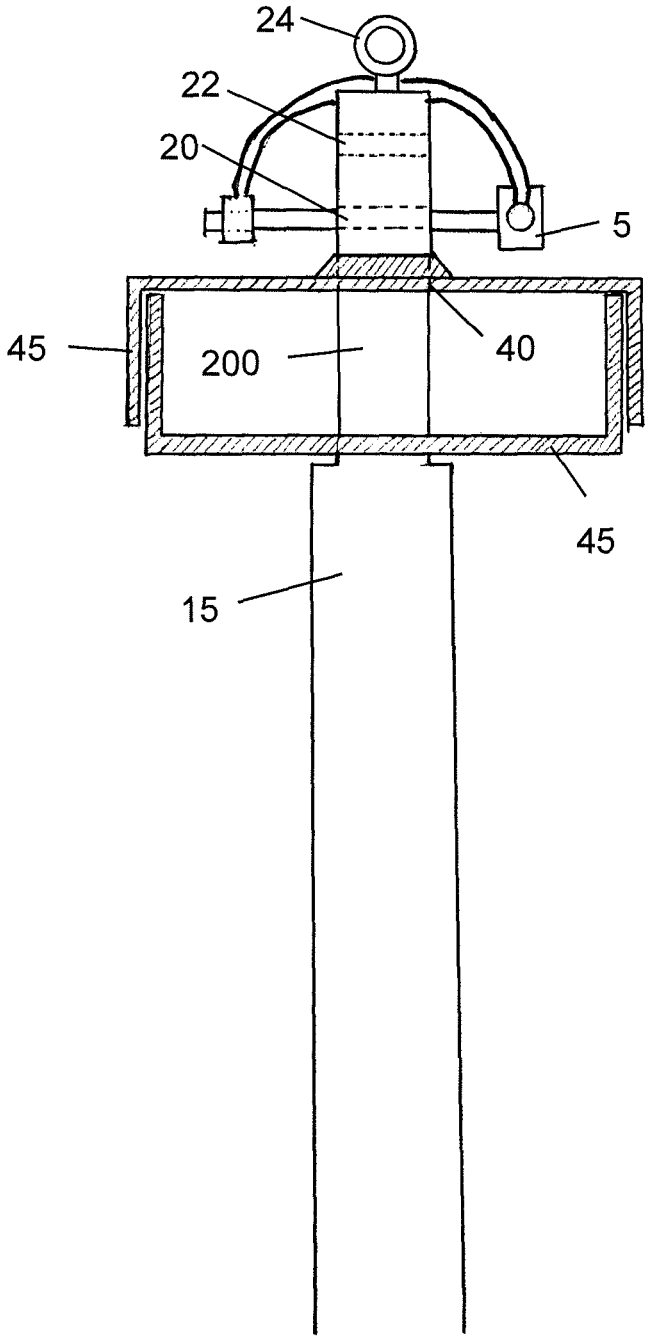
Figure 1C:
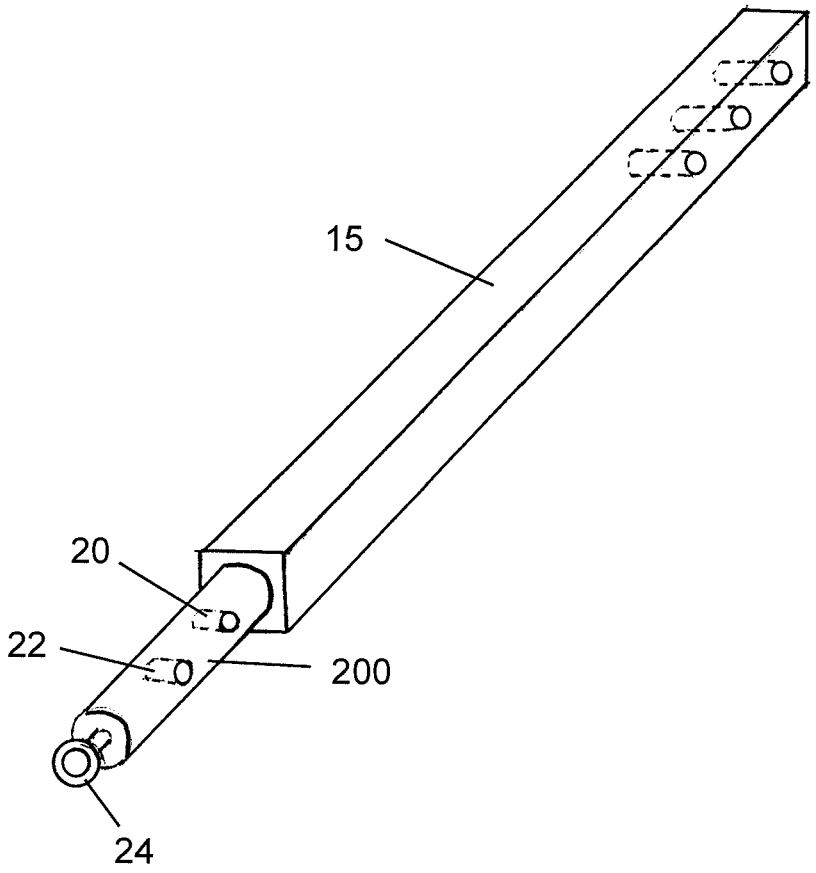
Figure 2A:
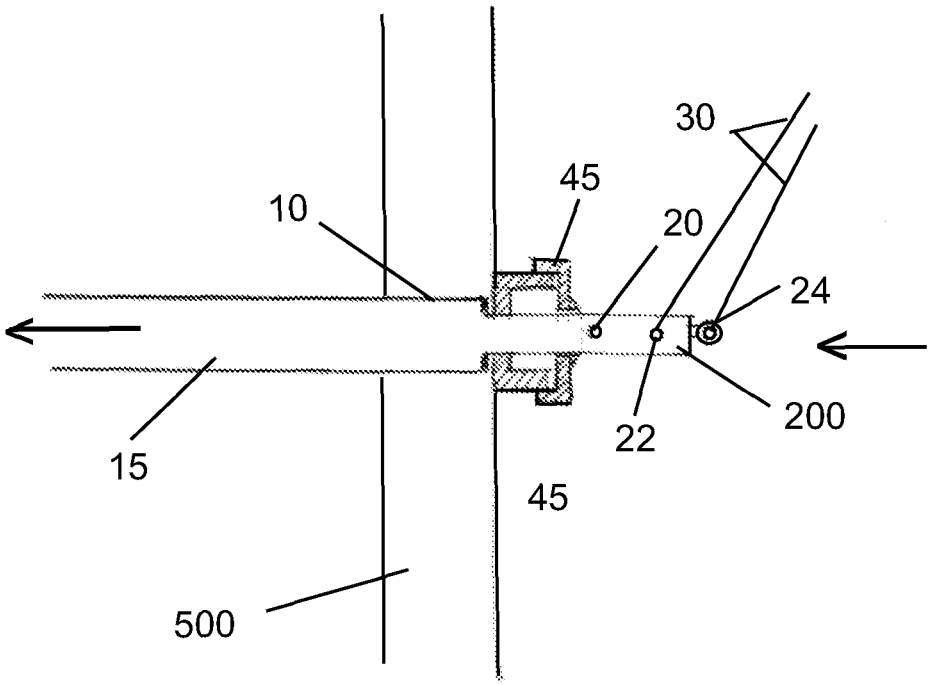
FIG. 2 is a movement diagram of the scaffold portion that attaches to the exterior end of the extension arm and the aperture in the building wall through which the extension arm extends for attachment on the interior end to the nail plate; this drawing illustrates how the scaffolding system can be lowered or removed using rope or cable after the extension arm has been pushed through the nail plate and wall aperture.
Figure 2B:
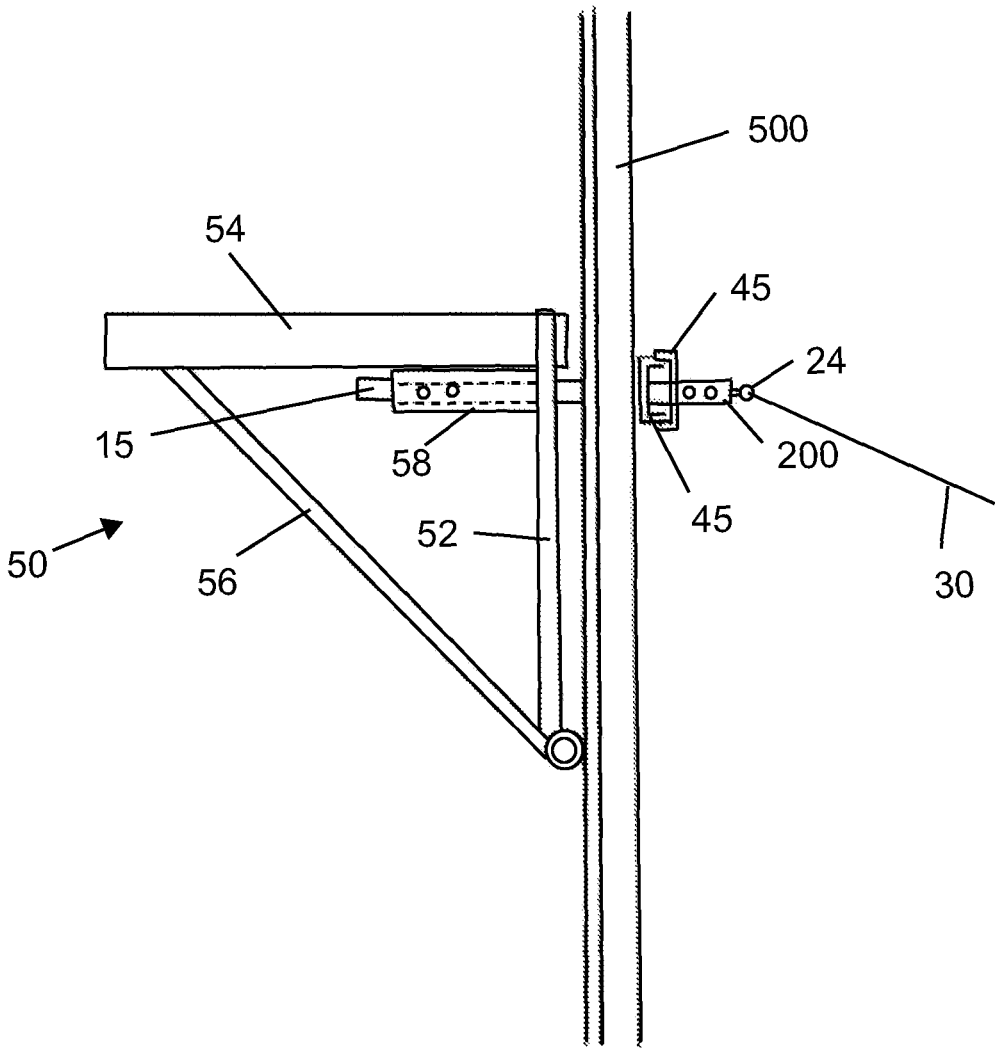

FIGS. 1 and 2 comprise the first embodiment to the purpose(s) of the present invention whereby the extension arm is a separate structure from the nail plate. The attaching bracket of the 630 patent was a permanent T-shaped structure held in place by an attaching bracket port and had to be removed from the interior of a building by one user while a second user removed the scaffold structure from the exterior of the building. The present improvement comprises the extension arm 15 being removably attached at the interior end to a standalone nail plate 45 whereby the improved standalone nail plate 45 is capable of being separately attached to a support structure 500. The improved extension arm structure herein includes a round post of approximately 2-4 inches in length extending axially outward from the extension arm interior end 200. Said post portion includes two small apertures 20 and 22 of approximately ¼ inch diameter that extend radially through the post and an eyelet 24 extending axially from post that is of a smaller outer diameter than that of the outer surface of the extension arm. Both apertures 20 and 22 are capable of having a pin 5 inserted through them or a support rope or cable 30. The improved nail plate herein includes a corresponding central aperture 40 through which said interior post end of the extension arm is inserted and held in place by insertion of a pin 5.

The improvement herein further comprises a method for removing or lowering the scaffolding system 50 whereby a single user attaches a rope or cable to the extension arm post aperture 22 and/or the eyelet 24, removes the extension arm interior end pin (assuming the extension arm and nail plate have been thus attached) and removes or lowers both the scaffolding 50 and extension arm (attached at the exterior end to the scaffold) by pushing the extension arm through the nail plate aperture 40 and wall aperture 10.

Figure 3A:
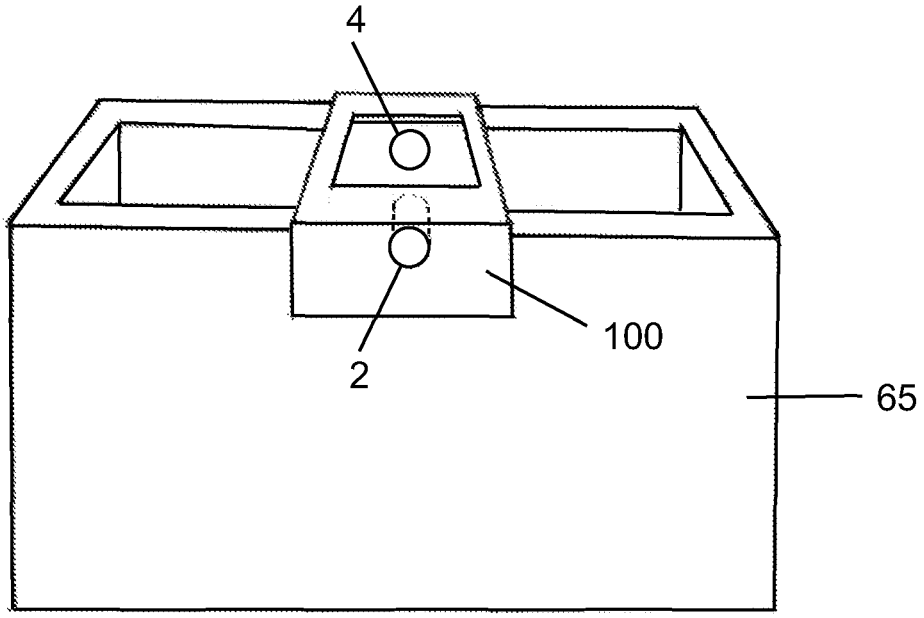
FIG. 3A is a perspective view of the spanner bracket and its threaded female portions showing how the aligned threaded female portions extend from what is the exterior surface of the wall all the way through both sides of the cement block.
Figure 3B:
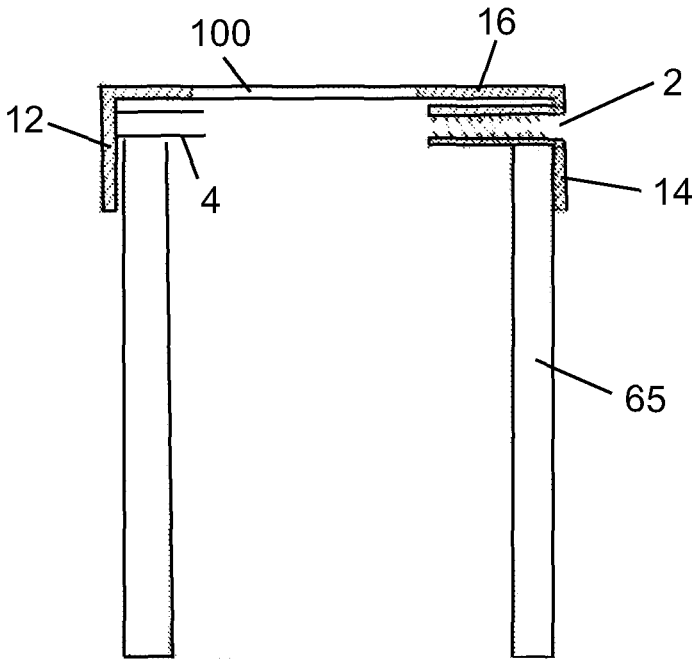
FIG. 3B is a perspective view of how the extension arm with threaded male end is screwed into the threaded female portion of the spanner bracket, and shows how the spanner bracket is held in place by the concrete blocks put in place above it while forming the wall.
Figure 4:
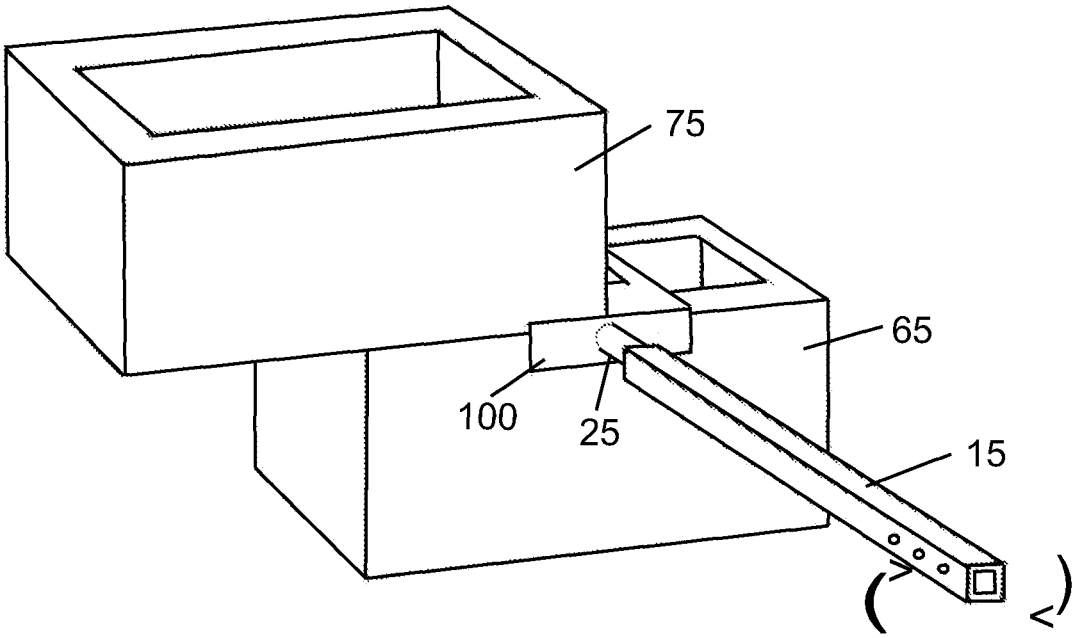

In an additional embodiment, the present improvement further comprises a spanner bracket 100 for use with cement block or pour in place concrete wall construction methods and an extension arm that terminates in a female threaded portion. The spanner bracket is generally a horizontal metal rectangular body with opposing interior 12 and exterior 14 downward extending vertical surfaces along two opposite sides of the horizontal body portion 16. As shown in FIGS. 3A-B, the spanner bracket 100 extends horizontally across the top of a cement block 65 (or pour in place concrete wall portion) and includes threaded female apertures 2 and 4 that are each approximately 2-3 inches in length and located in each of its vertical surfaces 12 and 14. A corresponding 8-12 inch threaded rod 25 is threaded through the entire cement block through both female apertures 2 and 4 with a least three inches being exposed for attachment to a corresponding female threaded portion 27 in the extension arm end. In use for the construction of a cement block or pour in place concrete wall, the spanner bracket 100 is placed over a cement block 65 or wall portion. At least one layer of cement blocks 75 are then added on top of the existing wall 65 thereby acting as a support structure used together with the spanner bracket to bear the load of the attached scaffolding (See FIG. 4). The threaded rod 25 is threaded into the spanner bracket female aperture portions 2 and 4 and the female end of the extension arm is threaded into the exposed exterior end of the threaded rod. The extension arm is then attached at the opposite end to the scaffolding. The spanner bracket holds the extension arm into place thereby also enabling the pinch-pull method for supporting the scaffolding load as disclosed in the 630 patent but for a cement block or pour in place cement wall. The threaded rod and spanner bracket are left as part of the built wall and the portion of the threaded rod extending out from the exterior side of the wall can either be cut off or left in place during finishing of the exterior surface of the wall.

The previous is a detailed description of embodiments of the present invention. As these embodiments of the present invention are described, various modifications or adaptations of the methods and or specific structures described may become apparent to those skilled in the art. All such modifications, adaptations, or variations that rely upon the teachings of the present invention, and through which these teachings have advanced the art, are considered to be within the spirit and scope of the present invention. Hence, the description is not to be considered in a limiting sense, as it is understood that the present invention is in no way limited to the embodiments described.

What is claimed is:

1. A scaffold system configured to be removably attached to a support structure having an aperture extending therethrough, the scaffold system comprises:

a scaffold configured to directly support a user when in a first position;

an extension arm having a first end and a second end, wherein the scaffold is attached to the extension arm, and wherein the extension arm has an aperture extending therethrough proximate the second end;

a nail plate having an aperture extending therethrough;

a pin;

a rope or cable;

wherein the scaffold system is configured to move between the first position and a second position; wherein, when the scaffold system is in the first position, the extension arm extends through the aperture of the support structure, the rope or cable does not extend through the aperture of the support structure, the second end extends through the aperture of the nail plate, and the pin extends through the aperture of the extension arm which retains the extension arm and scaffold in a fixed position with respect to the nail plate and the support structure so that the scaffold is fixedly attached to the support structure; and, when the scaffold system is in the second position, the pin does not extend through the aperture of the extension arm, the rope or cable is directly attached to the second end of the extension arm, the rope or cable extends through the aperture in the nail plate and the aperture in the support structure, the scaffold is detached from the support structure and positioned at a first height below a second height of the scaffold in the first position as a result of the scaffold being substantially supported by the rope or cable while being raised or lowered by the rope or cable.

2. The scaffold system of claim 1, wherein at least the second end of the extension arm has a cylindrical shape.

3. The scaffold system of claim 1, wherein the extension arm is oriented substantially perpendicular to the nail plate.

4. The scaffold system of claim 1, and further comprising an eyelet attached to the second end of the extension arm, wherein the rope or cable is attached to the eyelet.

5. The scaffold system of claim 4, wherein the eyelet has a width that is no larger than a width of the aperture in the nail plate.

6. The scaffold system of claim 1, wherein the scaffold comprises:

a vertical support member having a first end and a second end; and a horizontal support member having a first end and a second end, wherein the first end of the vertical support member is attached to the horizontal support member so that the vertical support member is substantially perpendicular to the horizontal support member.

7. The scaffold system of claim 6, and further comprising an attaching bracket port attached to the horizontal support member.

8. A method for lowering or removing the scaffold system of claim 4 from the support structure, the method comprising:

providing the scaffold system;

attaching the rope or cable to the extension arm;

removing the pin from the aperture of the extension arm; and lowering or removing the scaffold system from the support structure by lowering the rope or cable while securing substantially an entire weight of the scaffold system with the rope or cable.

* * * * *